US011408250B2

(12) United States Patent
Fripp et al.

(10) Patent No.: US 11,408,250 B2
(45) Date of Patent: Aug. 9, 2022

(54) ADJUSTING THE ZONAL ALLOCATION OF AN INJECTION WELL WITH NO MOVING PARTS AND NO INTERVENTION

(71) Applicant: Halliburton Energy Services, Inc., Houston, TX (US)

(72) Inventors: Michael Linley Fripp, Carrollton, TX (US); Maxime P M Coffin, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 762 days.

(21) Appl. No.: 16/321,813

(22) PCT Filed: Nov. 14, 2017

(86) PCT No.: PCT/US2017/061448
§ 371 (c)(1),
(2) Date: Jan. 29, 2019

(87) PCT Pub. No.: WO2019/098986
PCT Pub. Date: May 23, 2019

(65) Prior Publication Data

US 2021/0355787 A1 Nov. 18, 2021

(51) Int. Cl.
*E21B 34/08* (2006.01)
*E21B 34/10* (2006.01)
(Continued)

(52) U.S. Cl.
CPC ..... *E21B 34/08* (2013.01); *E21B 34/10* (2013.01); *E21B 41/0035* (2013.01);
(Continued)

(58) Field of Classification Search
CPC ..... E21B 34/08; E21B 34/10; E21B 41/0035; E21B 43/14; E21B 43/16; E21B 43/162; E21B 43/20; E21B 2200/02
See application file for complete search history.

(56) References Cited

U.S. PATENT DOCUMENTS 4,276,943 A * 7/1981 Holmes ..... F15C 1/22 175/40
4,387,770 A 6/1983 Hill
(Continued)

FOREIGN PATENT DOCUMENTS

WO WO-2013139601 A2 9/2013

OTHER PUBLICATIONS

Korean Intellectual Property Office, International Search Report and Written Opinion, PCT/US2017/061448, dated Aug. 14, 2018, 23 pages, Korea.

(Continued)

*Primary Examiner* — Jonathan Malikasim
(74) *Attorney, Agent, or Firm* — Haynes and Boone, LLP

(57) ABSTRACT

A downhole, interventionless system and method of controlling fluid flow from a tubular string into isolated zones of a wellbore annulus utilizing fluidic devices having different flow restriction characteristics. In an embodiment, the system includes multiple fluidic devices positioned on a work string in fluidically isolated zones of a wellbore. Each fluidic device is configured with a different flow restriction characteristic that results in a different flow rate response when a working fluid having a particular initial fluidic property is introduced into the fluidic devices. By altering the initial fluidic property of the working fluid, the flow rate from the work string into the corresponding isolated zone may be adjusted and optimally controlled without the need for additional manipulation of the fluidic devices.

20 Claims, 5 Drawing Sheets

(51) Int. Cl.

| | |
|---|---|
| ***E21B 41/00*** | (2006.01) |
| ***E21B 43/14*** | (2006.01) |
| ***E21B 43/16*** | (2006.01) |
| ***E21B 43/20*** | (2006.01) |

(52) U.S. Cl.
CPC ..... *E21B 43/14* (2013.01); *E21B 43/16* (2013.01); *E21B 43/162* (2013.01); *E21B 43/20* (2013.01); *E21B 2200/02* (2020.05)

(56) References Cited

U.S. PATENT DOCUMENTS

| | | | |
|---|---|---|---|
| 5,865,247 | A | 2/1999 | Paterson et al. |
| 8,291,976 | B2 | 10/2012 | Schultz et al. |
| 8,403,038 | B2 | 3/2013 | Russell et al. |
| 8,584,762 | B2 | 11/2013 | Fripp et al. |
| 8,714,266 | B2 | 5/2014 | Dykstra et al. |
| 9,145,766 | B2 | 9/2015 | Fripp et al. |
| 9,249,649 | B2 | 2/2016 | Fripp et al. |
| 2008/0173447 | A1* | 7/2008 | Da Silva ..... E21B 43/16 166/268 |
| 2012/0255739 | A1 | 10/2012 | Fripp et al. |
| 2013/0186634 | A1 | 7/2013 | Fripp et al. |
| 2014/0290776 | A1* | 10/2014 | Dykstra ..... F15C 1/02 137/810 |

OTHER PUBLICATIONS

Marcel N. Bouts and Marleen M. Rijkeboer, Design of Horizontal Polymer Injectors Requiring Conformance and Sand Control, Mar. 31-Apr. 2, 2014, 9 pages, SPE 169722, Society of Petroleum Engineers, SPE EOR Conference at Oil and Gas West Asia,, Muscat, Oman.

Kjetil Brakstad and Christian Rosenkilde, Modelling Viscosity and Mechanical Degradation ot Polyacrylamide Solutions in Porous Media, Apr. 11-13, 2016, 35 pages, Society of Petroleum Engineers, SPE Improved Oil Recovery Conference, Tulsa, Oklahoma, USA.

* cited by examiner

ADJUSTING THE ZONAL ALLOCATION OF AN INJECTION WELL WITH NO MOVING PARTS AND NO INTERVENTION

CROSS-REFERENCE TO RELATED APPLICATIONS

This application is a U.S. national stage patent application of International Patent Application No. PCT/US2017/061448, filed on Nov. 14, 2017, the benefit of which is claimed and the disclosure of which is incorporated herein by reference in its entirety.

FIELD OF THE DISCLOSURE

The present disclosure relates generally to the injection of fluids from a wellbore into a formation to enhance production. More specifically, the present disclosure relates to systems and methods for interventionless adjustment of fluid flow from a wellbore into a formation.

BACKGROUND

Typically the recovery of hydrocarbons from a formation to the surface occurs in multiple phases. In a primary recovery phase operation, a tubular string is positioned within a production wellbore to recover hydrocarbons that naturally rise to the surface. During this stage, well stimulation techniques such as acidizing or hydraulic fracturing may be utilized to improve hydrocarbon flow from the formation. In the event the pressure of the formation is insufficient to convey the hydrocarbons up through the tubular string, an artificial lift device may be disposed in the production wellbore on the tubular string. Despite this process, it is estimated that primary recovery phase operations can leave over fifty percent of the hydrocarbons in the formation.

In an attempt to recover the remaining hydrocarbons, enhanced hydrocarbon recovery methods may be employed. Specifically, an existing well or a newly drilled injection well may be used to introduce or inject various fluids into the formation to stimulate hydrocarbon production. In any event, a tubular string may be disposed within a wellbore for the conveyance of fluids to a target zone within the formation. Packers may be deployed along the tubing string to fluidically isolate various target zones. Flow control devices may be positioned along the tubular string adjacent the isolated zones to control fluid communication between the tubing string and the zone. Typical prior art flow control devices are valves that require actuation to control the rate of fluid flow therethrough. Currently, these valves may be actuated or adjusted by either pumping or dropping an object down the tubing string, deploying an umbilical for actuation or through the use of intervention tools lowered into the well on tubing. Each of these methods has disadvantages primarily associated with the inherent depth the valves must be placed to be in fluid communication with the formation. For instance, the dropped object may become stuck or lost within the wellbore, the umbilical may become damaged due to the temperatures encountered at the formation depth and the intervention tool may take days to position given the valve depth. Another method is to use Intelligent Completion valves, that can be actuated in real time through control lines (e.g., hydraulic, pneumatic or electric) and a control system. Such architecture adds significant costs compared to a standard completion due to feedthrough requirements, hydraulic power necessary and length of lines required.

Therefore each of these approaches for controlling flow through a flow control device has its drawbacks.

DESCRIPTION OF ILLUSTRATIVE EMBODIMENTS

Figure 1:
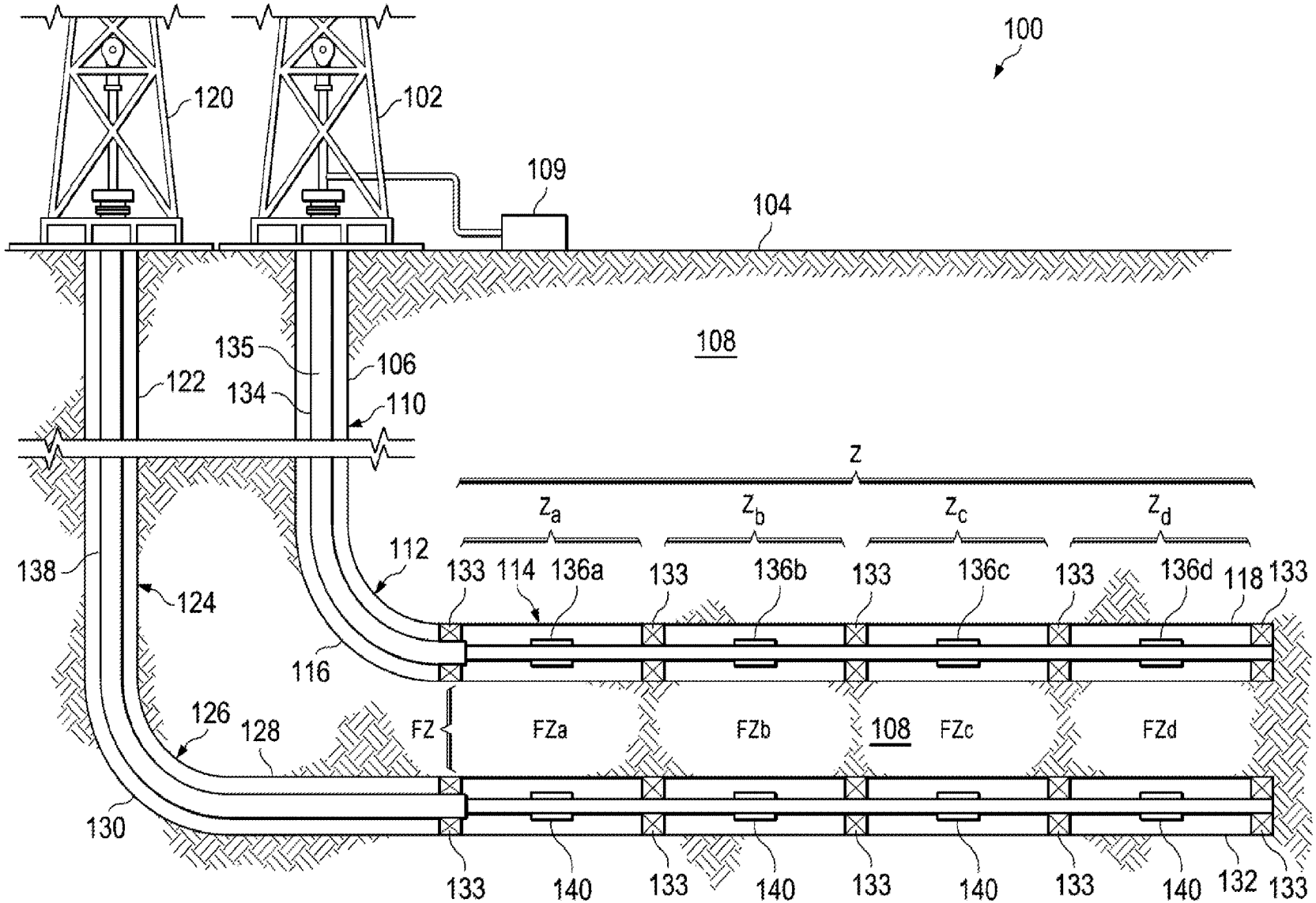
FIG. 1 depicts a schematic view of a system used in an enhanced hydrocarbon recovery operation using fluidic devices, according to one or more illustrative embodiments.

Embodiments of the present disclosure relate to interventionless systems and methods for controlling flow between a tubing string and isolated production zones within a formation. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although the systems and methods described herein are illustrated in the context of an enhanced hydrocarbon recovery operation, it is envisioned that they may be utilized in any application where fluid communication between a wellbore and the surrounding formation is desired. For instance, the systems and methods is described herein may be used in a hydraulic fracturing or an acidizing treatment process. In any event, with respect to generalized embodiments used in an enhanced hydrocarbon recovery operation, a system used to adjust the flow into isolated zones of a formation includes a first fluidic device of a first type positioned along a tubular string and spaced apart from a second fluidic device of a second type. A zonal isolation device such as a packer is disposed along the tubular string between the two fluidic devices to define distinct zones such that the first fluidic device controls fluid flow with a first zone and the second fluidic device controls fluid flow with a second zone. The fluidic devices are of different types in that the first fluidic device has a first fixed flow restriction characteristic and the second fluidic device has a second fixed flow restriction characteristic that is different from the first fixed flow restriction characteristic. A fluid desired for delivery to a particular zone is selected based on the type of fluidic device positioned at the zone for delivery. In particular, the characteristics of the fluid are selected so that the fluid will flow at a desired flow rate through one type of fluidic device, while impeded, based on the characteristics of the fluid, from flowing through the other type of fluidic device. For example, a base fluid may be mixed with an additive so as to have a first viscosity. The first fluidic device may be selected to allow flow therethrough of fluids with the first viscosity, while fluids with the first viscosity are inhibited by the second fluidic device from flowing through the second fluidic device. Thereafter, an additive may be mixed with the base fluid so as to have a second viscosity different from the first viscosity, where the second fluidic device permits flow of fluids with the second viscosity, while the first fluidic device inhibits flow of fluids with the second viscosity. In this way, the characteristics of the fluid within a tubing string determine which fluidic device the fluid will flow through.

Referring to FIG. 1, a schematic view of a system 100 used in an enhanced hydrocarbon recovery operation is illustrated. Although the system 100 is presented in an onshore environment, the method and systems described herein may also be implemented in an offshore setting. System 100 may be configured for producing and/or recovering hydrocarbons using a number of enhanced hydrocarbon recovery methods including, but not limited to, water flooding, chemical flooding, gas injection and thermal recovery. Likewise, system 100 may be used for injecting fluids into a wellbore at other stages of hydrocarbon recovery, including without limitation during acidizing operations or hydraulic fracturing operation. In any event, system 100 includes a first service rig 102 (e.g., a drilling rig, completion rig, or workover rig) that is positioned on the earth's surface 104 so as to service a first wellbore 106. The first wellbore 106 may be an existing wellbore or a wellbore constructed specifically for enhanced hydrocarbon recovery operations. To the extent multiple wellbores are utilized for a particular operation, the first wellbore 106 may be an injection wellbore 106, and for purposes of further discussion, first wellbore 106 will be described as injection wellbore 106. However, it will be understood that this is for illustrative purposes only and that system 100 need not have multiple wellbores. In any event, the injection wellbore 106 penetrates and is in fluid communication with a subterranean formation 108 containing native fluids, such as hydrocarbons. System 100 further includes a fluid source 109. Fluid source 109 may be configured to provide multiple types and concentrations of fluids to the service rig 102 including, but not limited to, water, gels, chemicals, polymers and various gases. While a service rig 102 is shown in FIG. 1, a service rig 102 may not be present, but rather, a standard surface wellhead completion (or sub-surface wellhead completion in some embodiments) may be associated with the system 100. The illustrated injection wellbore 106 includes as a vertical section 110 extending substantially vertically away from the earth's surface 104, which deviates over a deviated section 112 of the injection wellbore 106 until transitioning to a horizontal section 114 of the injection wellbore 106. The horizontal section 114 of the injection wellbore 106 may be defined by a heel 116 and a toe 118. The particular well trajectory described above if for illustrative purposes only and as such, the injection wellbore 106 may only include a substantially vertical section 110.

Although not necessary, system 100 may further include a second wellbore 122 that is likewise associated with a second service rig 120 (e.g., a drilling rig, completion rig, or workover rig) that is positioned on the earth's surface 104 so as to service second wellbore 122. In certain enhanced hydrocarbon recovery methods, second wellbore 122 may be a production wellbore 122, and for purposes of further discussion, second wellbore 122 will be described as production wellbore 122. Similar to the injection wellbore 106, the production wellbore 122 penetrates and is in fluid communication with the subterranean formation 108. While a production service rig 120 is shown in FIG. 1, in some embodiments, a service rig 120 may not be present, but rather, a standard surface wellhead completion (or sub-surface wellhead completion in some embodiments) may be associated with system 100. Similar to the injection wellbore 106, the production wellbore 122 may include a vertical section 124 extending substantially vertically away from the earth's surface 104, which deviates over a deviated section 126 of the production wellbore 122 until transitioning to a horizontal section 128 of the production wellbore 122. The horizontal section 128 of the production wellbore 122 may be defined by a heel 130 and a toe 132. Similar to the injection wellbore 106, the production wellbore 122 may only include a substantially vertical section 124.

In certain embodiments, annular zonal isolation devices 133 may be positioned within at least one of the injection wellbore 106 or the production wellbore 122 to fluidically isolate the segments of the wellbores 106, 122 into individual zones Z (e.g., $Z_a$, $Z_b$, $Z_c$, $Z_d$, preventing fluid communication between zones along the wellbore annulus. The annular isolation device 133 may be a packer or any expandable device that may be positioned within a wellbore and functions to isolate the wellbore into zones Z as known in the art.

The horizontal section 128 of the production wellbore 122 may be vertically offset below the horizontal section 114 of the injection wellbore 106. However it will be appreciated that, the horizontal section 128 of the production wellbore 122 may be vertically offset above the horizontal section 114 of the production wellbore 122. In some instances, the horizontal sections 114, 128 may be generally vertically offset from each other by tens or thousands of feet. In any event, zones Z along one wellbore, such as wellbore 106, may be defined so as to correspond with zones Z along another wellbore, such as wellbore 122, resulting in corresponding zones FZ (e.g., $FZ_a$, $FZ_b$, $FZ_c$, $FZ_d$, etc. . . . ) of the formation 108.

System 100 further includes a work string 134 (e.g., tubing string) having a central passage 135 therethrough for delivering fluid from fluid source 109 to the injection wellbore 106. The work string 134 is disposed within the injection wellbore 106 and generally contains a plurality of fluidic devices 136, at least some of which have different fixed, physical features resulting in different flow restriction characteristics of each fluidic device 136 as discussed further herein. As used herein, the term fluidic device is used to describe flow control devices that have no internal moving parts along an internal fluid flow path or a plurality of internal fluid flow paths of the flow control device. The plurality of fluidic devices 136 function to moderate and control the flow of fluids from the work string 134 into the annulus (e.g., the exterior of the work string 134) of injection wellbore 106. More specifically, each fluidic device 136 is designed in an outflow control configuration (e.g., facilitating fluid communication from the work string 134 to a zone Z and then into the formation 108) and operates without any external intervention. In some embodiments, the fluid devices 136 have no internal or external moving parts. In certain embodiments, each fluidic device 136 is disposed between a set of annular zonal isolation devices 133 adjacent a specific zone Z and operates to control flow from the injection work string 134 into the adjacent zone Z as defined by the set of annular isolation devices 133. FIG. 1 illustrates the injection work string 134 having four zones $Z_{a\text{-}d}$ and four corresponding fluidic devices 136*a-d*. However, in certain embodiments, the injection work string 134 may include more or fewer zones Z and fluidic devices 136, but at minimum will include at least two distinct zones Z and fluidic devices 136, each of the two fluidic devices 136 characterized by different flow restriction characteristics and associated with a different zone Z. Although FIG. 1 depicts the plurality of fluidic devices 136 in the horizontal section 114 of the injection wellbore 106, in certain embodiments the fluid devices may be disposed in the vertical section 110 of the injection wellbore 106.

Similar to the work string 134, system 100 comprises a production work string 138 (e.g., tubing string) for delivering fluid from the production wellbore 122 to the earth's surface 104. The production work string 138 is disposed in the production wellbore 122 and contains a plurality of fluidic tools 140. In some embodiments, the production work string 138 may include sand screens (not shown) between each set of annular zonal isolation devices 133. The fluidic tools 140 function to moderate and control the flow of fluids along the length of the production work string 138 from the formation 108 and annulus of the production wellbore 122 into the interior of work string 138. Contrary to the fluidic devices 136 on the injection work string 134, each fluidic tool 140 is configured in an inflow control configuration (e.g., facilitating fluid communication from the formation 108 into the production wellbore 122 zone Z and then into the production work string 138).

While system 100 is described above as comprising two separate wellbores 106, 122, alternative embodiments may be configured differently. As described above, system 100 may include only a single wellbore. Likewise, in such embodiments, work strings 134, 138 may both be located in the single wellbore. Alternatively, vertical sections 110, 124 of the work strings 134, 138 may both be located in a common wellbore but may each extend into different deviated and/or horizontal wellbore portions from the common vertical section. Alternatively, vertical sections 110, 124 of the work strings 134, 138 may be located in separate vertical wellbore section, but may both be located in a shared horizontal wellbore portion. In each of the above described embodiments, the fluidic devices 136 and the fluidic tools 140 may be used in combination and/or separately to deliver fluids to the wellbore with an outflow control configuration and/or to recover fluids from the wellbore with an inflow control configuration. Persons of ordinary skill in the art will appreciate that the foregoing wellbore configurations are provided for illustrative purposes only and that the disclosure is not limited to a particular wellbore configuration.

Still further, in alternative embodiments, any combination of the fluidic devices 136 may be located within a shared wellbore and/or amongst a plurality of wellbores and the fluidic devices 136 may be associated with different and/or shared isolated zones of the wellbores, the isolated zones, in some embodiments, being at least partially defined by one or more annular zonal isolation devices 133.

Figure 2:
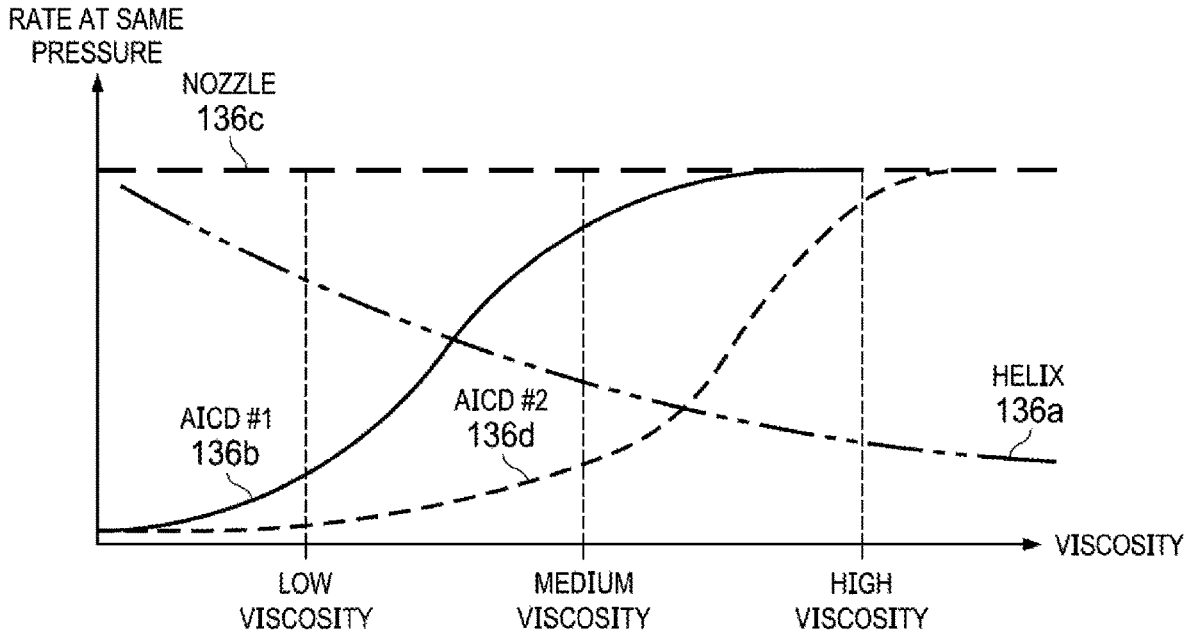
FIG. 2 is a graph illustrating the flow rate at an equal pressure through various types of fluidic devices as a function of viscosity.

With reference to FIG. 2, a graph illustrating a fluid flow rate of a working fluid at an equivalent pressure through various types of fluidic devices 136 as a function of a fluidic property is presented. In some embodiments, it is contemplated that the same working fluid will be utilized and a fluidic property of the working fluid may be altered, such as through a changed density, pressure or temperature or by mixing an additive, to adjust the property of the first fluid. In other embodiments, two or more different working fluids may be used, where each working fluid is selected so that the particular property of both working fluids is different. Although the disclosure is not limited to a particular type of fluid property for the working fluid, in one embodiment, the fluidic property is viscosity as shown in FIG. 2. In any event, as illustrated each fluidic device 136*a*, 136*b*, 136*c*, and 136*d* is configured to include a different flow restriction characteristic in response to an initial fluidic property of a first fluid. The different flow restriction characteristics refer to different individual, fixed physical features along the flow path defined within the fluidic device 136. In one embodiment, where the fluidic property is viscosity, the first fluid may have an "initial" or first viscosity and an "adjusted" or second viscosity. In alternative embodiments, the fluidic property of the working fluid to be adjusted may be the injection rate, shear rate behavior or the density of the working fluid, temperature or pressure. Further, in certain embodiments, at least one working fluid may be water. However, as discussed further herein, it will be appreciated in other embodiments additional fluids (e.g., gas, chemicals, etc. . . . ) may be used as a second working fluid or otherwise mixed or combined with the first fluid to alter the initial fluidic property.

In an embodiment, fluidic device 136*a* may be a helical type diode, which generally uses internal surface friction to generate a differential pressure across the device by spinning the flow before the flow exits the fluidic device 136*a*. Additionally, fluidic device 136*b* may be an autonomous fluid control device, which may contain a fluidic diode and a pathway through the diode specifically designed to restrict a fluid in response to a particular fluidic property. Further, fluidic device 136*c* may be a nozzle type diode, which uses fluid constriction to generate an instantaneous differential pressure across the device by forcing fluid from a larger area down through small diameter ports. Further still, fluidic device 136*d* may be an autonomous fluidic device similar to 136*b*, but designed to have fixed, physical features defining the flow path within the fluidic diode, which result in a different flow restriction characteristic in response to the same fluidic property. It will be appreciated that, in certain embodiments, the autonomous fluid control device may include, but is not limited to an autonomous inflow control device, an autonomous inflow control valve, a rate controlled production valve or a momentum valve.

As illustrated in FIG. 2, generally when the fluid pressure conveyed to the fluidic devices 136 are equal, helical type fluidic devices 136*a* provide more flow restriction to fluids with high viscosities, while both autonomous fluidic devices 136*b*, 136*d* provide more flow restriction to fluids with low viscosities. Additionally, flow restriction through a nozzle type fluidic device 136*c* generally remains constant regardless of the viscosity of the fluid. Although a helical, an autonomous and a nozzle type fluidic device have been described above, it is anticipated that other types of fluidic devices 136 may be used with the systems and methods described herein.

Thus optimum control and adjustment of the zonal distribution of injected fluids into the formation 108 can be achieved using an arrangement of fluidic devices 136 configured to have different restrictive properties. The foregoing is particularly desirable because the fluidic devices 136 do not require any form of mechanical intervention or configuration alteration to adjust flow rates through the fluidic devices. In addition, as a result of their individual flow restriction characteristics, the flow rate through each fluidic device 136 will be different in response to the initial fluidic property of the first fluid, which facilitates local or zonal control from each injection wellbore 106 zone Z into the formation 108.

This system and method of providing zonal control using various configurations of mechanically different fluidic devices is in contrast with conventional injection systems, which may require the positioning of coiled tubing, umbilicals, dropped objects or other tools hundreds if not thousands of feet below the earth's surface 104 to adjust the flow rate settings of a flow control device positioned within the wellbore. Moreover, these various forms of intervention are susceptible to becoming stuck or lost within a wellbore. Additionally, to the extent prior art systems do use fluidic devices, such fluidic devices used for different zones all have the same flow restriction characteristic. In other words, since each of the fluidic devices along a wellbore has the same flow restriction characteristic, the fluidic devices in separate zones will all exhibit the same flow rate response in the presence of a working fluid. These types of prior art systems are operable to provide a the same flow rate through various wellbore zones into the formation 108, but lacks the ability to adjust and control the flow rate through individual injection wellbore 106 zones Z into the formation 108.

Figure 3A:
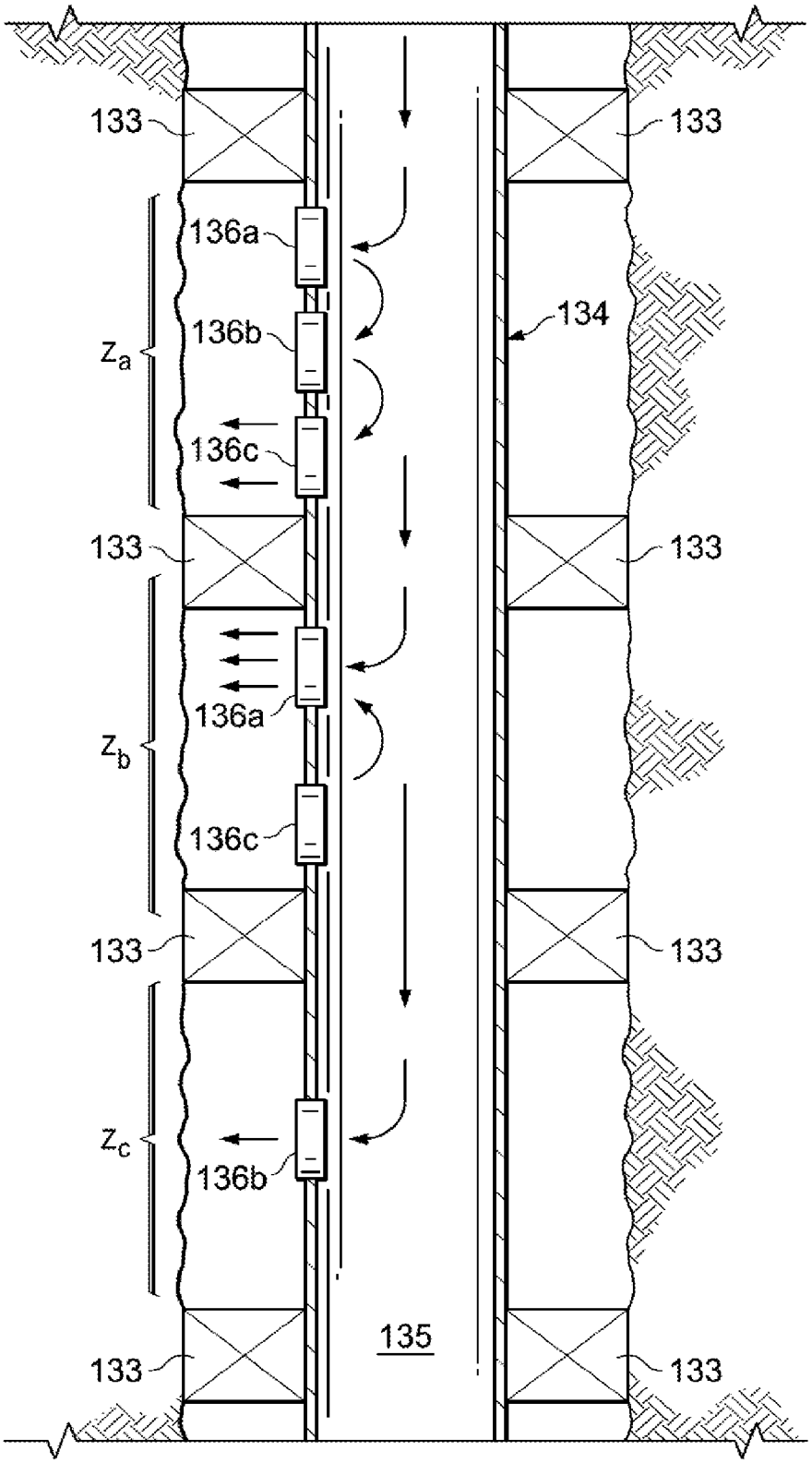
FIG. 3A depicts a cross-sectional view of an alternative embodiment of a system used in an enhanced hydrocarbon recovery operation, with multiple fluidic devices of different types being positioned in serial fluid communication with the zone, according to one or more illustrative embodiments.
Figure 3B:
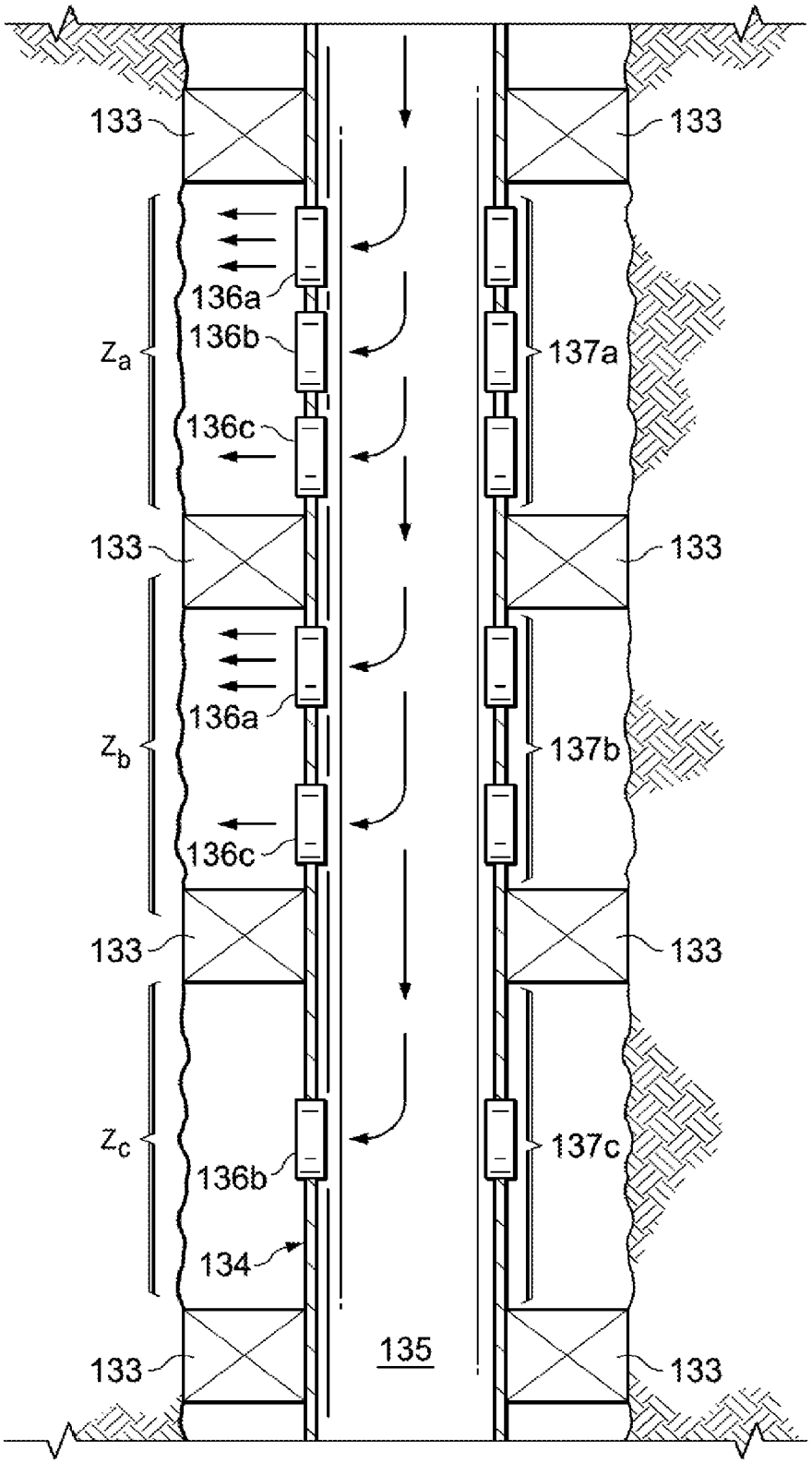
FIG. 3B depicts a cross-sectional view of an alternative embodiment of the system used in an enhanced recovery operation, with multiple fluidic devices of different types positioned in parallel fluid communication with the zone, according to one or more illustrative embodiments.

FIGS. 3A and 3B illustrate alternative embodiments of the fluidic devices 136 on the injection work string 134 in which the fluidic devices operate in parallel and series to communicate fluid from the work string 134 to the injection wellbore 106 zone Z. Thus, FIGS. 3A and 3B illustrates a portion of the wellbore 106 having zones $Z_a$, $Z_b$ and $Z_c$ defined there along by zonal isolation devices 133 carried by work string 134. A first group 137*a* of fluidic devices 136*a*, 136*b*, 136*c* are arranged to communicate with zone $Z_a$ while a second group 137*b* of fluidic devices 136*a*, 136*c* are arranged to communicate with zone $Z_b$ and a third group 137*c* of fluidic devices 136*b* are arranged to communicate with zone $Z_c$. It will be appreciated that each fluidic device 136 within a group will be individually responsive to a fluidic property of a working fluid in a different way, such that the group overall may have a different flow rate than another group comprised of a different set of fluidic devices. In this regard, a working fluid may flow through a particular group in parallel or series, but at different flow rates to yield an overall flow rate to the zone Z. For example, fluidic device 136*a* of group 137*a* may have a first flow rate, whereas each of fluidic devices 136*b* and 136*c* of group 137*a* may have different flow rates. It will be appreciated that by varying the type and number of fluidic devices assigned to any one zone Z, the degree of interventionless control of a working fluid injected into a particular zone Z increases.

In FIG. 3A, fluidic devices 136*a*, 136*b*, 136*c* are illustrated as arranged for serial flow within any given zone Z (although it should be noted that in addition, FIG. 3A illustrates parallel flow with respect to all of the zones Z). More specifically, as shown in zone $Z_a$, fluidic devices 136*a*, 136*b*, 136*c* are arranged so that working fluid flow (illustrated by the arrows) from the central passage 135 of work string 134 first enters into fluidic device 136*a* and upon exit, is directed to fluidic device 136*b* and upon exit, is directed to fluidic device 136*c*, where the fluid flow exists into the annulus of zone $Z_a$. In other words, the working fluid flow (as represented by the arrows) progresses serially through the aligned fluidic devices 136*a*, 136*b*, and 136*c*. In this embodiment, fluidic devices 136*a*, 136*b* and 136*c* may function to allow a working fluid within a desired range to pass through the fluidic devices into the annulus. For example, fluidic device 136*a* may allow only a working fluid having a viscosity below a select poise to pass therethrough. Subsequently, fluidic device 136*b* may allow only a working fluid having a viscosity above a select poise to pass therethrough. In this way, the serial fluidic devices 136*a*, 136*b* function as a band pass filter would in the electromagnetic arts. Fluidic device 136*c* may be utilized to fine tune the fluid flow even more, such that the ultimate flow rate for this set of fluidic devices may be achieved as represented by the double arrows. Operating simultaneously in zone $Z_b$ is a separate set of fluidic devices 136*a*, 136*c*. As illustrated by the triple arrows, a high flow is achieved by passing the working fluid flow first to fluidic device 136*c* and then to fluidic device 136*a* before discharge into the annulus of wellbore 106. Operating simultaneously in zone $Z_c$ is a single fluid device 136*b*. In zone $Z_c$, no additional fluidic devices 136 are utilized to band pass or attenuate the fluid flow.

In FIG. 3B, fluidic devices 136*a*, 136*b*, 136*c* are illustrated as arranged for parallel flow within any given zone Z. More specifically, as shown in zone $Z_a$, fluidic devices 136*a*, 136*b*, 136*c* are arranged so that working fluid flow (illustrated by the arrows) from the central passage 135 of work string 134 is introduced to each of fluidic devices 136*a*, 136*b* and 136*c* simultaneously. However, the individual flow restriction characteristic of each fluidic device 136 determines its response. Thus, fluidic device 136*a* has a high flow rate or volume of working fluid passing therethrough (as illustrated by triple arrows); while fluidic device 136*b* prevents or significantly attenuates flow therethrough and fluidic device 136*c* has a low flow rate or volume of working fluid passing therethrough (as illustrated by the single arrow). In other words, the working fluid flow (as represented by the arrows) may pass in parallel through each of the adjacent fluidic devices 136*a*, 136*b*, and 136*c*. In this embodiment, fluidic devices 136*a*, 136*b* and 136*c* may be arranged to fine tune the volume of working fluid flowing into the annulus. Operating simultaneously in zone $Z_b$ is a separate set of fluidic devices 136*a*, 136*c*, where it can be seen from the arrows that fluidic device 136*a* permits a large fluid volume to pass therethrough (or the passage of fluid at a higher flow rate), while fluidic device 136*c*, simultaneously and in parallel, allows a smaller fluid volume to pass therethrough (of the passage of the fluid at a lower flow rate). Operating simultaneously in zone $Z_c$ is a single fluid device 136*b*. In zone $Z_c$, fluidic device 136*b* prevents or significantly attenuates flow therethrough. Although the embodiments described in FIGS. 3A and 3B show two fluidic devices 136 in each wellbore 106 zone Z, any wellbore 106 zone Z may be configured with any number of multiple fluidic devices 136 having different flow restriction characteristics from one another, which may be arranged for parallel flow or serial flow, as desired.

Figure 4:
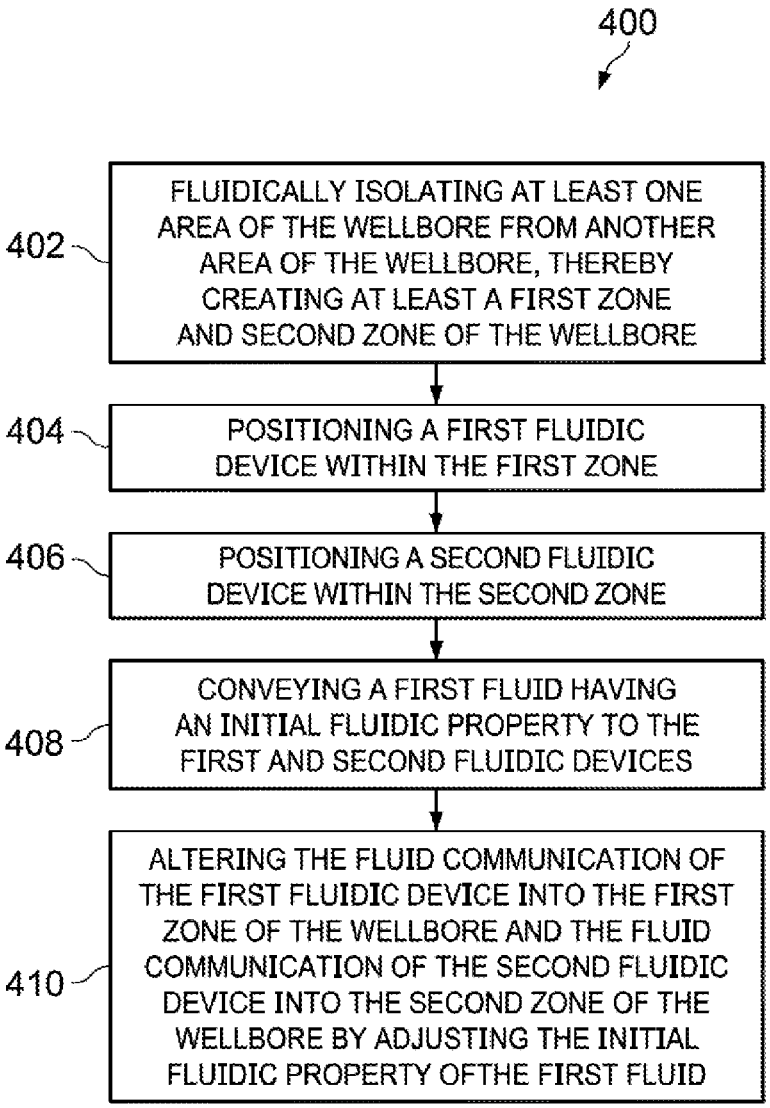
FIG. 4 is a flowchart illustrating an exemplary interventionless method for adjusting flow from a wellbore into a production zone of a formation using fluidic devices, according to one or more illustrative embodiments.

With reference to FIG. 4, a flow chart of an exemplary method 400 for a downhole, interventionless control of a fluid flow from a wellbore 106 into a formation 108 using fluidic devices 136 is illustrated.

Method 400 begins in step 402, by fluidically isolating at least one portion of the annulus of a wellbore 106 from another portion of the annulus of the wellbore 106. In certain embodiments, annular zonal isolation devices 133 may be positioned at spaced apart locations within the wellbore 106 to fluidically isolate the segments of the annulus of wellbore 106 into individual zones Z (e.g., $Z_a$, $Z_b$, $Z_c$, $Z_d$, etc. . . . ). The annular isolation device 133 may be a packer or any expandable device that may be positioned within a wellbore and functions to isolate the wellbore into segments as known in the art. Typically, the annular isolation devices 133 are carried on a work string 134 run into wellbore 106. Once the work string 134 is in position, the annular isolation devices 133 are activated so as to fluidically isolate portions of the annulus as previously described. After individual zones Z (e.g., $Z_a$, $Z_b$, $Z_c$, $Z_d$, etc. . . . ) in the wellbore 106 have been established through the foregoing step, in step 404, a first fluidic device 136 having an outflow configuration, in certain embodiments fluidic device 136*a*, is positioned adjacent a first zone Z (e.g., $Z_a$) of the wellbore 106. In one or more embodiments, the first fluidic device 136 may be carried on the same work string 134 as annular isolation devices 133 so that positioning the isolation devices 133 also positions the first fluidic device 136. In other embodiments, the first fluidic device 136 may be positioned utilizing a different work string. In any event, the first fluidic device 136 is positioned to control fluid flow from the interior of the tubing string on which it is carried to the annulus of the zone Z at which it is positioned. The first fluidic device 136 is selected based on a first flow restriction characteristic, the first flow restriction characteristic being the fixed, physical fluid flow path within the first fluidic device 136. It will be understood by persons of ordinary skill in the art that when a first fluid having an initial fluidic property is introduced into the first fluidic device 136, the first fluid will flow through the flow path at a flow rate determined based on the flow path and the initial fluidic property.

Similarly in step 406, a second fluidic device 136 having an outflow configuration, in certain embodiments fluidic device 136*b*, is positioned adjacent a second zone (e.g., $Z_b$) of the wellbore 106. The second fluidic device 136*b* is selected to have a different flow restriction characteristic than the flow restriction characteristic of the first fluidic device 136*a*. More specifically, the second flow restriction characteristic is different from the first flow restriction characteristic. In certain embodiments steps 404 and 406 may be performed simultaneously. Additionally in another embodiment, at the same time, additional fluidic devices 136, such as a third fluidic device 136, in certain embodiments fluidic device 136*c*, and a fourth fluidic device 136, in certain embodiments fluidic device 136*d*, may be positioned adjacent a third (e.g., $Z_c$) and a fourth (e.g., $Z_d$) zone Z of the wellbore 106, respectively. It will be appreciated that step 406 may yet further include positioning additional fluidic devices 136 having different flow restriction characteristics than the previously positioned fluidic devices 136 within other individual zones Z of the wellbore 106.

In yet another embodiment, steps 404 and 406 may include the placement of multiple fluidic devices 136, in certain embodiments fluidic devices 136*a*, 136*b* and 136*c*, within an individual zone Z of the injection wellbore 106 as shown in FIGS. 3A and 3B. In this embodiment, the fluidic devices 136*a* and 136*b* may facilitate fluid outflow from the work string 134 to the zone Z of the wellbore 106 in parallel. In other words, for one or more zones Z, multiple fluidic devices 136 may be positioned adjacent the zone Z, where two or more fluidic devices 136 positioned adjacent a zone Z have different flow restriction characteristics (such as fluidic devices 136*a* and 136*b*) such that a working fluid flowing into the zone Z through one fluidic device 136 will have a first flow rate into the zone Z and that the fluid flowing into the zone Z through another adjacent fluidic device 136 will have s second flow rate into the zone Z. Alternatively, in some embodiments, the fluidic devices 136*a* and 136*b* may be configured in series such that fluid conveyed through the work string 134 must pass through multiple fluidic devices 136*a* 136*b* and 136*c*, but may only flow out of one of the fluidic devices 136*a*, 136*b* or 136*c* in the zone Z of the injection wellbore 106. Thus, although FIGS. 3A and 3B present up to three fluidic devices 136 being positioned in an individual zone Z of the wellbore 106, it will be appreciated that this embodiment of steps 404 and 406 may include any plurality of fluidic devices 136 having different flow restriction characteristics being positioned in an individual zone Z of the wellbore 106.

In any event, once the first and second fluidic devices 136, separated by annular zonal isolation devices 133 are positioned within a desired zone Z within the wellbore 106, in step 408, a first fluid having a first or initial fluidic property may be conveyed to the first and second fluidic devices 136. In a preferred embodiment, the first fluid may be conveyed to the first and second fluidic devices 136 simultaneously. In certain embodiments, the first fluid is drawn from a fluid source 109 adjacent the earth's surface 104 and using the service rig 102 conveyed into the central passage 135 of the work string 134 to the first and second fluidic devices 136. In one embodiment, the first fluid may be water and the initial fluidic property may be a low viscosity. In this scenario, if the first fluidic device 136 is a helical type fluidic device 136*a*, and the second fluidic device 136 is an autonomous fluidic device 136*b*, then more flow will be introduced via second fluidic device 136*b* into the zone $Z_a$ than will be introduced into zone $Z_b$ associated with the second fluidic device 136*b*. This is due to the different flow restriction characteristics between the helical and autonomous fluidic devices 136*a*, 136*b*, it being understood that if a working fluid with a higher viscosity is conveyed along the work string 134 in this scenario, then more working fluid will be introduced via second fluidic device 136*b* to the zone $Z_b$ than will be introduced into zone $Z_a$ associated with the first fluidic device 136*a*.

Finally in step 410, the flow rate of the working fluid through each separate fluidic device 136 may be altered by adjusting a fluidic property of the working fluid. Specifically, the fluid communication of the first fluidic device 136 into the first zone Z of the injection wellbore 106 and the fluid communication of the second fluidic device 136 into a second zone Z of the injection wellbore 106 may be altered by adjusting the initial fluidic property of the first fluid. In some embodiments, the initial fluidic property may be adjusted by altering the temperature or pressure of the working fluid. In some embodiments, the initial fluidic property may be adjusted by mixing the working fluid with an additive that alters the fluidic property. For example, the working fluid may be mixed with an additive that changes the fluidic property from a first viscosity to a second viscosity that is different than the first viscosity. Alternatively, adjusting the initial fluidic property may simply involve replacing the first working fluid with a second working fluid that has different properties than the first working fluid. In certain embodiments, adjusting the initial fluidic property of the first fluid may result in cessation of flow across at least one of the fluidic devices 136, while in other embodiments; the flow rate changes from a first flow rate to a second flow rate different than the first flow rate.

Due to the different flow restriction characteristics of the fluidic devices 136 disposed in individual zones Z along the string 134, adjusting the initial fluidic property of the first fluid will result in a change in flow rate through each of the fluidic devices 136, which convey flow from the working string 134 to the individual zones Z of the wellbore 106. For example, during an enhanced hydrocarbon recovery operation, it may be desirable to convey a smaller volume of the first fluid, which in an embodiment may have an initial fluidic property of low viscosity, into the formation 108 at the heel 116 of the wellbore 106, than at the toe 118 of the wellbore 106. If the heel 116 is located adjacent an wellbore 106 zone Z associated with a helical type fluidic device 136*a* and the toe 118 is adjacent an wellbore 106 zone Z associated with an autonomous fluidic device 136*b*, the desired zonal control may be accomplished through altering the initial fluidic property of the first fluid by increasing its viscosity. Increasing the viscosity of the first fluid in this scenario, will result in an increase of fluid flow rate at the toe 118 of the wellbore 106 through the autonomous type fluidic device 136*b* and at the same time a decrease of fluid flow rate at the heel 116 of the wellbore 106 through the helical type fluidic device 136*a*. Although the example of above describes the use of two fluidic devices 136, it will be appreciated that this methodology may be employed using any plurality of fluidic devices 136 with different flow restriction characteristics, positioned at spaced apart locations along the work string 134 in the wellbore 106.

This process facilitates adjustment and control flow of the first fluid into individual zones Z of the wellbore 106. The process may be implemented to equalize the outflow of native fluids from the formation 108 in the corresponding zones FZ into the wellbore 122 and the work string 138. Additionally, this process may be used to equalize the flow of the first fluid from the work string 134 in each of the wellbore 106 zones Z and the adjacent formation 108 zones FZ. In some embodiments, adjusting the initial fluidic property of the first fluid may occur by adjusting the injection rate, head pressure, density, shear rate behavior or viscosity of the first fluid.

As stated above, adjusting the viscosity of the first fluid may occur in any number of ways. For example if the first fluid is water, in an embodiment, the viscosity of the first fluid may be adjusted by the addition of salts. Additionally, the viscosity of the first fluid may be adjusted by the addition of a second fluid having a different viscosity. In certain embodiments, the second fluid may be a gas or a polymer gel. The polymer gel may be a synthetic polymer or a biopolymer. Most biopolymers degrade with the exposure to high temperatures. The biopolymer will operate to adjust the viscosity of the first fluid upon encountering the fluidic device 136. As the first fluid mixed with the biopolymer is conveyed through the fluidic device 136 and the wellbore 106 zone Z into the formation 108, the viscosity will become reduced as the biopolymer degrades due to the exposure to the temperature of the formation 108. This process facilitates adjusting the zonal distribution of flow into wellbore 106 and additionally prevents having a different viscosity fluid in the formation 108. In another embodiment, the initial fluidic property of the first fluid may be changed to a subsequent fluidic property in the formation 108 using a time delay acid system, which releases an acid in response to the temperature of the formation 108. In some instances, a delayed-release acid may be injected along with the first fluid into the work string 134. The delayed release acid may be polymers from hydroxy acids, which include but are not limited to magnesium peroxide or calcium peroxide.

In other embodiments, the additive or the second fluid may be any number of chemical solutions including, but not limited to, friction reducers or dehydrated acid. Additionally in another embodiment the viscosity of the first fluid may be adjusted by changing the temperature of the first fluid.

Furthermore, the viscosity of the first fluid may be adjusted by mixing it with the second fluid and adjusting the conveyance rate of the resulting mixed fluid. For example a first fluid, which in certain embodiments may be water, may be mixed with a second fluid, which in certain embodiments be a polymer gel. By increasing or decreasing the conveyance rate of the mixed fluid within the working string 134 a shear stress is imparted on to the mixed fluid. This shear stress will result in production of different apparent viscosities between the first fluid and the second fluid in the mixed fluid.

Thus an interventionless method for controlling fluid flow into a formation has been descried herein, wherein the method includes fluidically isolating at least one area of a wellbore from another area of the wellbore, thereby creating at least a first wellbore zone and a second wellbore zone; positioning a first fluidic device adjacent the first wellbore zone, the first fluidic device having a first flow restriction characteristic responsive to an initial fluidic property of a first fluid; positioning a second fluidic device adjacent the second wellbore zone, the second fluidic device having a second flow restriction characteristic that is different from the first flow restriction characteristic; conveying the first fluid having the initial fluidic property to the first and second fluidic devices; and altering fluid communication of the first fluidic device into the first wellbore zone and fluid communication of the second fluidic device into the second wellbore zone by adjusting the initial fluidic property of the first fluid; wherein the first fluidic device communicates with the first wellbore zone at a first flow rate and the second fluidic device communicates with the second wellbore zone at a second flow rate different than the first flow rate, and the adjustment to the initial fluidic property changes the respective flow rates of the first and second fluidic devices.

For the foregoing embodiment, the method may include any of the following steps alone or in combination with each other:

Adjusting the initial fluidic property of the first fluid thereby causing the flow rate of the first fluid through one of the first or second fluidic devices to increase and the flow rate of the first fluid through the other of the first or second fluidic devices to decrease.

Adjusting the initial fluidic property of the first fluid by altering a viscosity of the first fluid.

Adjusting the initial fluidic property of the first fluid by altering a density of the first fluid.

Adjusting the initial fluidic property of the first fluid by conveying a second fluid into the wellbore along with the first fluid.

Adjusting the initial fluidic property of the first fluid by altering a head pressure of the first fluid.

Adjusting the initial fluidic property of the first fluid by altering a temperature of the first fluid.

Adjusting the initial fluidic property of the first fluid to a second fluidic property in situ once the first fluid has passed through its respective fluidic device using a polymer or a time delay acid system.

Adjusting the initial fluidic property of the first fluid as the first fluid is conveyed through the first fluidic device and the second fluidic device.

Adjusting the initial fluidic property of the first fluid, thereby equalizing an outflow of native fluids within the formation as between the first wellbore zone and the second wellbore zone.

Adjusting the initial fluidic property of the first fluid, thereby equalizing the flow rate of the first fluid through the formation as between a first zone of the formation and a second zone of the formation.

Additionally an alternative interventionless method for adjusting an allocation of flow from a wellbore into a formation has been described herein, wherein the method includes positioning a first fluidic device in a wellbore adjacent a first zone of a wellbore; positioning a second fluidic device in a wellbore adjacent a second zone of a wellbore; conveying a first fluid having a first fluid property to the first and second fluidic devices to cause the first fluid to be communicated through the first fluidic device to the first zone of the wellbore at a first flow rate and the first fluid to be communicated through the second fluidic device to the second zone of the wellbore at a second flow rate different than the first flow rate; and altering the respective flow rates through the first and second fluidic devices by adjusting the first fluid property of the first fluid.

For the foregoing embodiment, the method may include any of the following steps alone or in combination with each other:

Altering the flow rate of either the first or second fluidic device to zero by adjusting the first fluid property of the first fluid.

Increasing the flow rate through one of the fluidic devices and decreasing the flow rate through the other fluidic device.

Introducing the first fluid to the first and second fluidic devices substantially simultaneously.

Additionally an alternative interventionless method for adjusting an allocation of flow from a wellbore into a formation has been described herein, wherein the method includes positioning a first, second and third fluidic devices adjacent first, second and third isolated zones of the wellbore; delivering a working fluid to the first, second and third fluidic devices; and simultaneously communicating the working fluid through the first fluidic device to the first zone at a first flow rate, communicating the working fluid through the second fluidic device to the second zone at a second flow rate, and communicating the working fluid through the third fluidic device to the third zone at a third flow rate, wherein at least one of the flow rates is different than the other two flow rates.

For the foregoing embodiment, the method may include any of the following steps alone or in combination with each other:

Communicating the working fluid through each of fluidic devices at flow rates that are different from each other.

Adjusting the flow rates through the fluidic devices by adjusting a property of the fluid, wherein the flow rate through any given fluidic device is dependent on a fluidic property of the working fluid.

Thus a downhole, interventionless system for controlling fluid flow into a formation has been described. Embodiments of the system may include a tubular string having a central passage therethrough; a first fluidic device disposed along the tubular string at a first location to permit fluid flow from the central passage to an exterior of the tubing string, the first fluidic device having a first fixed flow restriction characteristic; a second fluidic device disposed along the tubular string at a second location spaced apart from the first location, the second fluidic device positioned to permit fluid flow from the central passage to the exterior of the tubing string, the second fluidic device having a second fixed flow restriction characteristic that is different from the first fixed flow restriction characteristic; and an annular zonal isolation device positioned along the tubular string between the first and second locations.

For the foregoing embodiment, the wellbore fluid communication tool may further include any one of the following elements, alone or in combination with each other:

The first fluidic device further including physical features that are different than the physical features of the second fluidic device.

The second fluidic device being operable to facilitate fluid communication between the central passage of the tubular string and a second zone of the formation.

A third fluidic device configured with a third fixed flow restriction characteristic that is different from that of the first fluidic device and the second fluidic device, wherein: the third fluidic device is disposed at a third location along the tubular string that is spaced apart from the first location and the second location adjacent a third zone of the formation and is fluidically isolated from the first location and the second location; and the third fluidic device is operable to facilitate fluid communication between central passage of the tubular string and a third zone of the formation.

A fourth fluidic device configured with a fourth fixed flow restriction characteristic that is different from that of the first fluidic device, the second fluidic device and the third fluidic device, wherein: the fourth fluidic device is disposed at a fourth location along the tubular string that is spaced apart from the first location, the second location and third location adjacent a fourth zone of the formation and is fluidically isolated from the first location, the second location, and the third location; and the fourth fluidic device is operable to facilitate fluid communication between central passage of the tubular string and a fourth zone of the formation.

The first fixed flow restriction characteristic of the first fluidic device is configured to cause flow restriction through the first fluidic device to increase in response to an increase in an initial fluidic property of a first fluid and decrease in response to a decrease in the initial fluidic property of the first fluid.

The first fluidic device is selected from the group consisting of a helix fluidic device, a nozzle fluidic device and an autonomous fluidic control device.

The second fluidic device is selected from the group consisting of a helix fluidic device, a nozzle fluidic device and an autonomous fluidic control device.

The third fluidic device is selected from the group consisting of a helix fluidic device, a nozzle fluidic device and an autonomous fluidic control device.

The fourth fluidic device is selected from the group consisting of a helix fluidic device, a nozzle fluidic device and an autonomous fluidic control device.

An additional fluidic device disposed along the tubular string at a first location to permit fluid flow from the central passage to an exterior of the tubing string, the additional fluidic device having a fixed flow restriction characteristic that is different from the first fixed flow restriction characteristic.

An additional fluidic device disposed along the tubular string at one of the first or second locations to permit fluid flow from the central passage to an exterior of the tubing string at that location, the additional fluidic device having a fixed flow restriction characteristic that is different from the fixed flow restriction characteristic of the other fluidic device disposed at that location.

Additionally an alternate embodiment of an interventionless system for adjusting an allocation of flow from a wellbore into a formation has been described herein. Such an embodiment may include a tubular string having a central passage therethrough; a first fluidic device, configured with a first flow restriction characteristic in response to an initial fluidic property of a first fluid disposed along the tubular string at a first location adjacent a first zone of the formation; a second fluidic device, configured with a flow restriction characteristic that is different from that of the first fluidic device in response to the initial fluidic property of the first fluid, disposed along the tubular string at a second location spaced apart from the first location adjacent the first zone of the formation; an annular zonal isolation device positioned along the tubular string to fluidically isolate the first zone of the formation from a second zone of the formation within the wellbore; a third fluidic device, configured with a flow restriction characteristic that is different from that of the first fluidic device and the second fluidic device in response to the initial fluidic property of the first fluid, disposed along the tubular string adjacent the second zone of the formation; and a fourth fluidic device, configured with a flow restriction characteristic that is different from that of the first fluidic device, the second fluidic device and the third fluidic device in response to the initial fluidic property of the first fluid, disposed along the tubular string at a location spaced apart from the third fluidic device adjacent the second zone of the formation.

For the foregoing embodiment, the wellbore fluid communication tool may further include any one of the following elements, alone or in combination with each other:

A serial fluid communication path between the central passage of the tubular string, the first fluidic device, the second fluidic device and the formation.

A serial fluid communication path between the central passage of the tubular string, the third fluidic device, the fourth fluidic device and the formation.

What is claimed is:

1. A downhole, interventionless method of controlling fluid flow into a formation, the method comprising:

fluidically isolating at least one area of a wellbore from another area of the wellbore, thereby creating at least a first wellbore zone and a second wellbore zone;

positioning a first set of fluidic devices adjacent the first wellbore zone to control an overall flow into the first wellbore zone, the first set of fluidic devices including one or more fluidic devices defining a first flow restriction characteristic responsive to an initial fluid property of a first fluid;

positioning a second set of fluidic devices adjacent the second wellbore zone to control an overall flow into the second wellbore zone, the second set of fluidic devices including one or more fluidic devices having different fixed, physical features than the one or more fluidic devices of the first set of fluidic devices to define a second flow restriction characteristic that is different from the first flow restriction characteristic;

conveying the first fluid having the initial fluid property to the first and second sets of fluidic devices, wherein the first set of fluidic devices communicates with the first wellbore zone at a first overall flow rate and the second set of fluidic devices communicates with the second wellbore zone at a second overall flow rate different than the first flow rate to establish an initial zonal distribution of fluid flow into the formation between the first and second zones; and altering fluid communication of the first fluidic device into the first wellbore zone and fluid communication of the second fluidic device into the second wellbore zone by adjusting the initial fluid property of the first fluid;

wherein the adjustment to the initial fluid property changes the respective flow rates of the first and second sets of fluidic devices to adjust the zonal distribution of fluid flow between the first and second zones.

2. The interventionless method according to claim 1, wherein the flow rate of the first fluid through one of the first or second sets of fluidic devices increases and the flow rate of the first fluid through the other of the first or second sets of fluidic devices decreases in response to the adjustment of the initial fluid property of the first fluid.

3. The interventionless method according to claim 1, wherein adjusting the initial fluid property of the first fluid comprises altering at least one of the group consisting of a viscosity of the first fluid, a density of the first fluid, and a temperature of the first fluid.

4. The interventionless method according to claim 1, wherein adjusting the initial fluid property of the first fluid comprises conveying a second fluid into the wellbore along with the first fluid.

5. The interventionless method according to claim 1, further comprising adjusting the initial fluid property of the first fluid to a second fluid property in the formation once the first fluid has passed through its respective set of fluidic devices, wherein the adjusting is performed using a polymer or a time delay acid system.

6. The interventionless method according to claim 1, wherein adjusting the initial fluid property of the first fluid occurs as the first fluid is conveyed through the first set of fluidic devices and the second set of fluidic devices.

7. The interventionless method according to claim 1, whereby adjusting the initial fluid property of the first fluid, at least one of an outflow of native fluids within the formation is equalized as between the first wellbore zone and the second wellbore zone and the flow rate of the first fluid through the formation is equalized as between a first zone of the formation and a second zone of the formation.

8. A downhole, interventionless system for controlling an allocation of fluid flow into a formation, the system comprising:

a tubular string having a central passage therethrough;

a first set of fluidic devices disposed along the tubular string at a first location to permit fluid flow from the central passage to a first wellbore zone on an exterior of the tubing string, the first set of fluidic devices having physical features that define a first fixed flow restriction characteristic such that the first set of fluidic devices is operable to allocate an overall fluid flow into the formation at the first wellbore zone;

a second set of fluidic devices disposed along the tubular string at a second location spaced apart from the first location, the second fluidic device positioned to permit an overall fluid flow from the central passage to a second wellbore zone on the exterior of the tubing string, the second set of fluidic devices having physical features that are different than the physical features of the first set of fluidic devices such that the physical feature of the second set of fluidic devices define a second fixed flow restriction characteristic that is different from the first fixed flow restriction characteristic such that the second set of fluidic devices is operable to allocate an overall fluid flow into the formation at the second location that is greater than the overall fluid flow in to the formation at the first location; and an annular zonal isolation device positioned along the tubular string between the first and second locations.

9. The interventionless system of claim 8, further comprising a third set of fluidic devices configured with a third fixed flow restriction characteristic that is different from that of the first set of fluidic devices and the second set of fluidic devices, wherein:

the third set of fluidic devices is disposed at a third location along the tubular string that is spaced apart from the first location and the second location adjacent a third wellbore zone and is fluidically isolated from the first location and the second location; and the third set of fluidic devices is operable to facilitate fluid communication between the central passage of the tubular string and the third wellbore zone; and a fourth set of fluidic devices configured with a fourth fixed flow restriction characteristic that is different from that of the first set of fluidic devices, the second fluidic device set of fluidic devices and the third fluidic device set of fluidic devices, wherein:

the fourth set of fluidic devices is disposed at a fourth location along the tubular string that is spaced apart from the first location, the second location and third location adjacent a fourth wellbore zone and is fluidically isolated from the first location, the second location, and the third location; and the fourth set of fluidic devices is operable to facilitate fluid communication between the central passage of the tubular string and the fourth wellbore zone.

10. The interventionless system of claim 9, wherein at least one fluidic device of the first, second, third and fourth sets of fluidic devices is selected from the group consisting of a helix fluidic device, a nozzle fluidic device and an autonomous fluidic control device.

11. The interventionless system of claim 9, further comprising a serial fluid communication path between the central passage of the tubular string, the third set of fluidic devices, and the formation.

12. The interventionless system of claim 8, wherein the first fixed flow restriction characteristic of the first set of fluidic devices causes flow restriction through the first set of fluidic devices to increase in response to an increase in an initial fluid property of a first fluid and decrease in response to a decrease in the initial fluid property of the first fluid.

13. The interventionless system of claim 8, wherein the first set of fluidic devices comprises a first fluidic device and an additional fluidic device disposed along the tubular string at the first location to permit fluid flow from the central passage to the first wellbore zone on the exterior of the tubing string, the additional fluidic device having a fixed flow restriction characteristic that is different from a fixed flow restriction characteristic of the first fluidic device.

14. The interventionless system of claim 8, wherein one of the first and second sets of fluidic devices comprises a first fluidic device and an additional fluidic device disposed along the tubular string at one of the first or second locations to permit fluid flow from the central passage to the first or second wellbore zone on the exterior of the tubing string at that location, the additional fluidic device having a fixed flow restriction characteristic that is different from a fixed flow restriction characteristic of the first fluidic device disposed at that location.

15. The interventionless system of claim 8, further comprising a serial fluid communication path between the central passage of the tubular string, the first fluidic device set of fluidic devices, and the formation.

16. An interventionless method of adjusting an allocation of flow from a wellbore into a formation, the method comprising:

positioning a first set of fluidic devices in the wellbore adjacent a first zone of the wellbore to control an overall flow into the first wellbore zone, the first set of fluidic devices including one or more fluidic devices defining a first flow restriction characteristic responsive to a first fluid property of a first fluid;

positioning a second set of fluidic devices in the wellbore adjacent a second zone of the wellbore to control an overall flow into the second wellbore zone, the second set of fluidic devices including one or more fluidic devices having physical features that are different than the physical features of the first set of fluidic devices such that the physical feature of the second set of fluidic devices define a second flow restriction characteristic responsive to the first fluid property of the first fluid;

conveying the first fluid having the first fluid property to the first and second sets of fluidic devices to cause the first fluid to be communicated through the first set of fluidic devices to the first zone of the wellbore at a first flow rate and the first fluid to be communicated through the second set of fluidic devices to the second zone of the wellbore at a second flow rate different than the first flow rate to establish an initial zonal distribution of fluid flow into the formation among the first and second zones of the wellbore; and altering the respective flow rates through the first and second fluidic devices by adjusting the first fluid property of the first fluid to adjust the zonal distribution of fluid flow into the formation among the first and second zones of the wellbore.

17. The method of claim 16, wherein altering comprises increasing the flow rate through one of the sets of fluidic devices and decreasing the flow rate through the other of the sets of fluidic devices.

18. The method of claim 16, wherein conveying comprises introducing the first fluid to the first and second sets of fluidic devices substantially simultaneously.

19. The method of claim 16, wherein adjusting the first fluid property of the first fluid comprises altering a viscosity of the first fluid.

20. The method of claim 19, wherein altering the viscosity of the first fluid includes mixing an additive with the first fluid.

* * * * *